US007347768B1

(12) United States Patent
Drew

(10) Patent No.: US 7,347,768 B1
(45) Date of Patent: Mar. 25, 2008

(54) APPARATUS AND METHOD TO TEST ABRASION RESISTANCE OF MATERIAL USING AIRBORNE PARTICULATE

(75) Inventor: Christopher P. Drew, Dracut, MA (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/499,981

(22) Filed: Jul. 28, 2006

(51) Int. Cl.
*B24C 3/06* (2006.01)

(52) U.S. Cl. ..... 451/38; 451/75; 451/120; 73/7

(58) Field of Classification Search ..... 451/75–120, 451/36; 73/7
See application file for complete search history.

(56) References Cited

U.S. PATENT DOCUMENTS

| | | | | | |
|---|---|---|---|---|---|
| 2,907,200 | A | * | 10/1959 | Roberts et al. | 73/7 |
| 3,229,498 | A | * | 1/1966 | Oakes | 73/7 |
| 4,048,918 | A | * | 9/1977 | Peck | 101/114 |
| 4,144,740 | A | | 3/1979 | Beatty | |
| 4,232,487 | A | * | 11/1980 | Brown | 451/88 |
| 4,305,278 | A | | 12/1981 | Stewart | |
| 4,395,850 | A | * | 8/1983 | Brown | 451/90 |
| 4,462,245 | A | | 7/1984 | Gould | |
| 4,507,953 | A | | 4/1985 | Vandermeerssche | |
| 4,633,701 | A | | 1/1987 | Einlehner | |
| 4,938,055 | A | | 7/1990 | Tsuda | |
| 4,939,922 | A | | 7/1990 | Smalley | |
| 5,343,733 | A | | 9/1994 | Nakayawa | |
| 5,531,634 | A | * | 7/1996 | Schott | 451/39 |
| 5,533,382 | A | | 7/1996 | Clerkin | |
| 5,542,281 | A | | 8/1996 | Lee | |
| 5,835,621 | A | | 11/1998 | Vandermeerssche | |
| 6,412,330 | B1 | | 7/2002 | Dicello | |
| 2005/0120774 | A1 | | 6/2005 | Shinohara | |

FOREIGN PATENT DOCUMENTS

| | | |
|---|---|---|
| GB | 1246683 | 9/1971 |
| JP | 4098143 | 3/1992 |
| JP | 2002340764 | 11/2002 |
| JP | 2004061341 | 2/2004 |
| JP | 2005114482 | 4/2005 |
| JP | 2005164369 | 6/2005 |

* cited by examiner

*Primary Examiner*—Joseph J. Hail, III
*Assistant Examiner*—Anthony Ojini
(74) *Attorney, Agent, or Firm*—Vincent J. Ranucci

(57) ABSTRACT

An apparatus and method to test the abrasion resistance of materials. In one embodiment, the apparatus comprises a conduit network, a primary air stream generating device to generate a primary air stream in the conduit network, a secondary air stream generating device to produce a secondary air stream in the conduit network, and a particulate handling device to deposit particulate into the conduit network so that the particulate enters the secondary air stream. The conduit network merges the secondary air stream into the primary air stream to allow the particulate to enter the primary air stream, and allow the primary air stream to blow the particulate at a test sample positioned within the conduit network.

7 Claims, 3 Drawing Sheets

Fig. 1

APPARATUS AND METHOD TO TEST ABRASION RESISTANCE OF MATERIAL USING AIRBORNE PARTICULATE

STATEMENT OF GOVERNMENT INTEREST

The invention described herein may be manufactured and used by or for the Government of the United States of America for Governmental purposes without payment of any royalties thereon or therefore.

BACKGROUND OF THE INVENTION

1. Field of the Invention

The present invention relates to an apparatus and method to simulate abrasion in a controlled manner caused by air-borne particulates.

2. Description of the Prior Art

Prior art techniques for testing abrasion resistance, such as the Taber test and the Bayer test, typically use a rubbing or scratching mechanism to test materials for abrasion resistance. Specifically, either an abrasive material is rubbed across the test sample surface, or the test sample is rubbed against an abrasive surface. While these tests do provide valuable data, they do not accurately or reliably predict resistance to impact damage from wind-borne particulate matter. These prior art techniques are typically used to test hard protective coatings to determine their resistance to scratching. However, such protective coatings are prone to shattering upon impact of a fast moving object, such as a grain of sand. Consequently, coatings and materials may pass a prior art abrasion test, e.g. Taber test, but fail rapidly when exposed to an environment wherein there is blowing or airborne particulate. Furthermore, many prior art abrasion testers use a relatively slow time scale damage event that is not representative of the applied stresses and strain rates induced by the impact of windborne or airborne particulates. The timescale of the impact is significantly shorter than the damage from a prior art rubbing-type test which may cause a shift in polymer materials from ductile to brittle failure modes.

What is needed is an apparatus and method to accurately and reliably test the abrasion resistance of a material to impact damage from wind-borne or airborne particulate matter.

SUMMARY OF THE INVENTION

Accordingly, it is an object of the present invention to provide an apparatus and method that can test the resistance of a material to the impact of air-borne or wind-borne particulate matter.

It is another object of the present invention to provide an apparatus and method to test the resistance of a material to impact of air-borne or wind-borne particulate matter which can be implemented at reasonable cost.

It is a further object of the present invention to provide an apparatus to test the resistance of a material to impact of air-borne or wind-borne particulate matter wherein the apparatus is relatively smaller in size than prior art abrasion testing devices.

It is a further object of the present invention to provide an apparatus to test the resistance of a material to impact of air-borne or wind-borne particulate matter wherein the test duration with the apparatus can be shorter than weathering and wear under natural conditions.

Other objects and advantages of the present invention will be apparent from the ensuing description and the accompanying drawings.

Thus, in one aspect, the present invention is directed to an apparatus to test the abrasion resistance of materials, comprising a conduit, an air stream generating device to generate an air stream in the conduit, and a device to deposit particulate into the conduit so that the air stream blows the particulate toward a test sample positioned in the conduit.

In a related aspect, the present invention is directed to an apparatus to test the abrasion resistance of materials comprising a conduit network, a primary air stream generating device to generate a primary air stream in the conduit network, a secondary air stream generating device to produce a secondary air stream in the conduit network, and a particulate handling device to deposit particulate into the conduit network so that the particulate enters the secondary air stream. The conduit network merges the secondary air stream into the primary air stream to allow the particulate to enter the primary air stream and to allow the primary air stream to blow the particulate a test sample positioned within the conduit network.

In one embodiment, the apparatus of the present invention generally comprises a large fan or blower to generate a constant primary air stream having a velocity between about 10 and 60 mph. This primary air stream is directed at a test sample. A motorized auger or other type of device meters a particulate into a secondary air stream powered by a second, relatively smaller, blower or fan. A conduit or duct network connects the two airstreams such that a constant volume (or mass) of particulate per-unit-time is introduced into the primary air stream that is directed at the test sample.

In a related aspect, the present invention is directed to a method to test the abrasion resistance of materials, comprising the steps of providing a conduit, generating an air stream in the conduit, and depositing particulate into the conduit so that the air stream blows the particulate toward a test sample positioned in the conduit.

In a further aspect, the present invention is directed to a method for testing the abrasion resistance of materials, comprising generating a primary air stream, generating a secondary air stream, depositing particulate into the secondary air stream, merging the secondary air stream into the primary air stream to allow particulate to enter the primary air stream, and directing the primary air stream at a test sample.

Important features of the present invention include the capability to vary (i) the air speed of the primary air stream, (ii) the particulate density in the primary air stream, and (iii) the particulate itself.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawings, in which.

DESCRIPTION OF THE PREFERRED EMBODIMENTS

Figure 1:
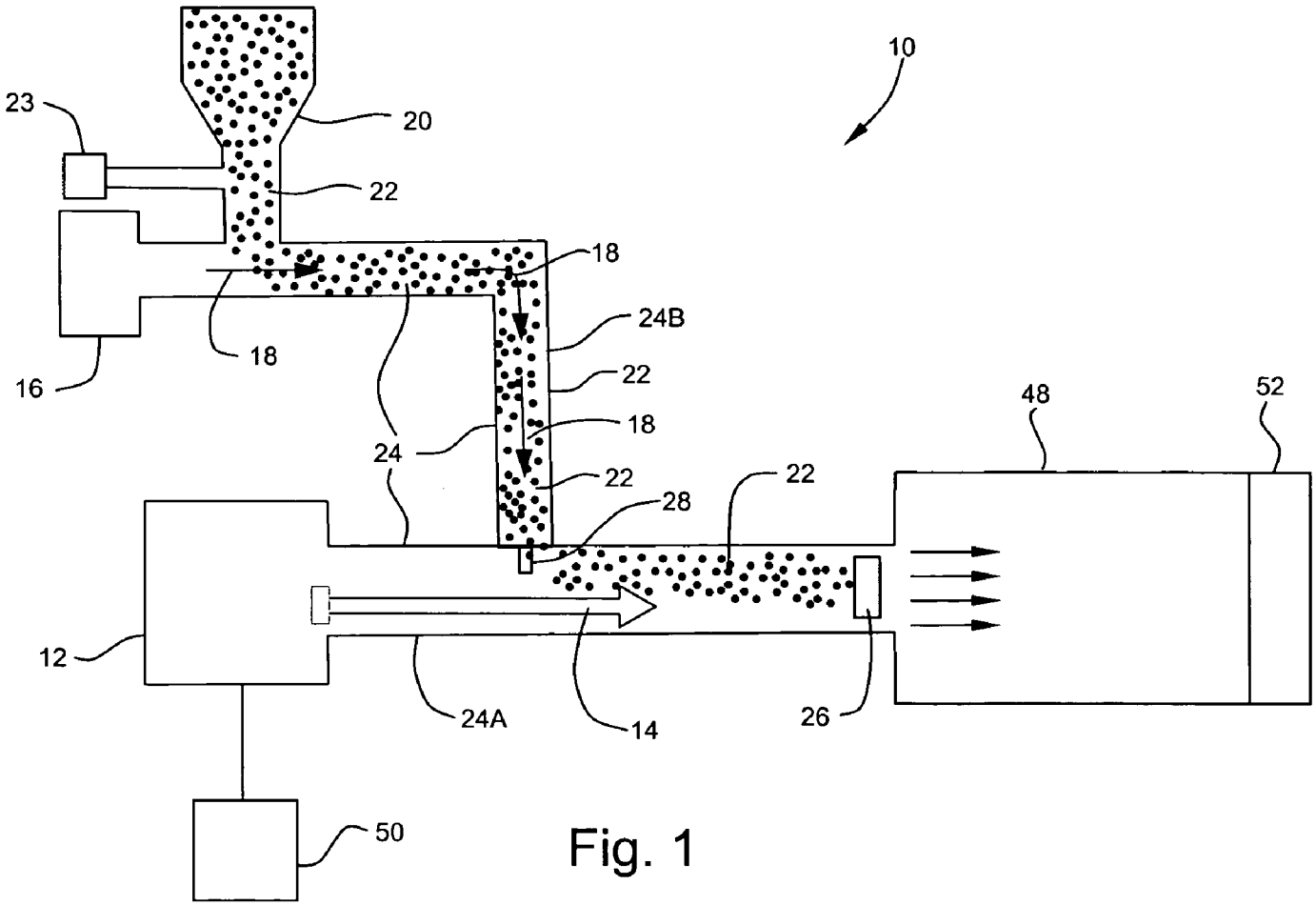
FIG. 1 is a diagram of an apparatus to test the abrasion resistance of materials in accordance with one embodiment of the present invention.

Referring to FIG. 1, there is shown apparatus 10 for testing the abrasion resistance of materials in accordance with a preferred embodiment of the invention. Apparatus 10 generally comprises a primary air stream generating device 12 to generate a primary air stream 14 and secondary air stream generating device 16 to produce a secondary air stream 18. Apparatus 10 further comprises particulate handling device 20 to deposit particulate 22 into the secondary air stream 18. In a preferred embodiment, particulate handling device 20 comprises a device 23 to meter the particulate 22 into secondary air stream 18. In one embodiment, particulate handling device 20 comprises a motorized auger. Apparatus 10 further comprises conduit network 24. Conduit network 24 comprises conduit network sections 24A and 24B. Conduit network section 24B merges secondary air stream 18 into conduit network section 24A so as to allow particulate 22 to enter primary air stream 14. Conduit network section 24A directs primary air stream 14 at a test sample 26 positioned within conduit network section 24A. In one embodiment, primary air stream generating device 12 and secondary air stream generating device 16 are configured as fans. In another embodiment, primary air stream generating device 12 and secondary air stream generating device 16 are configured as blowers. Conduit network 24 can be configured as with pipes, ducts, etc.

Figure 2:
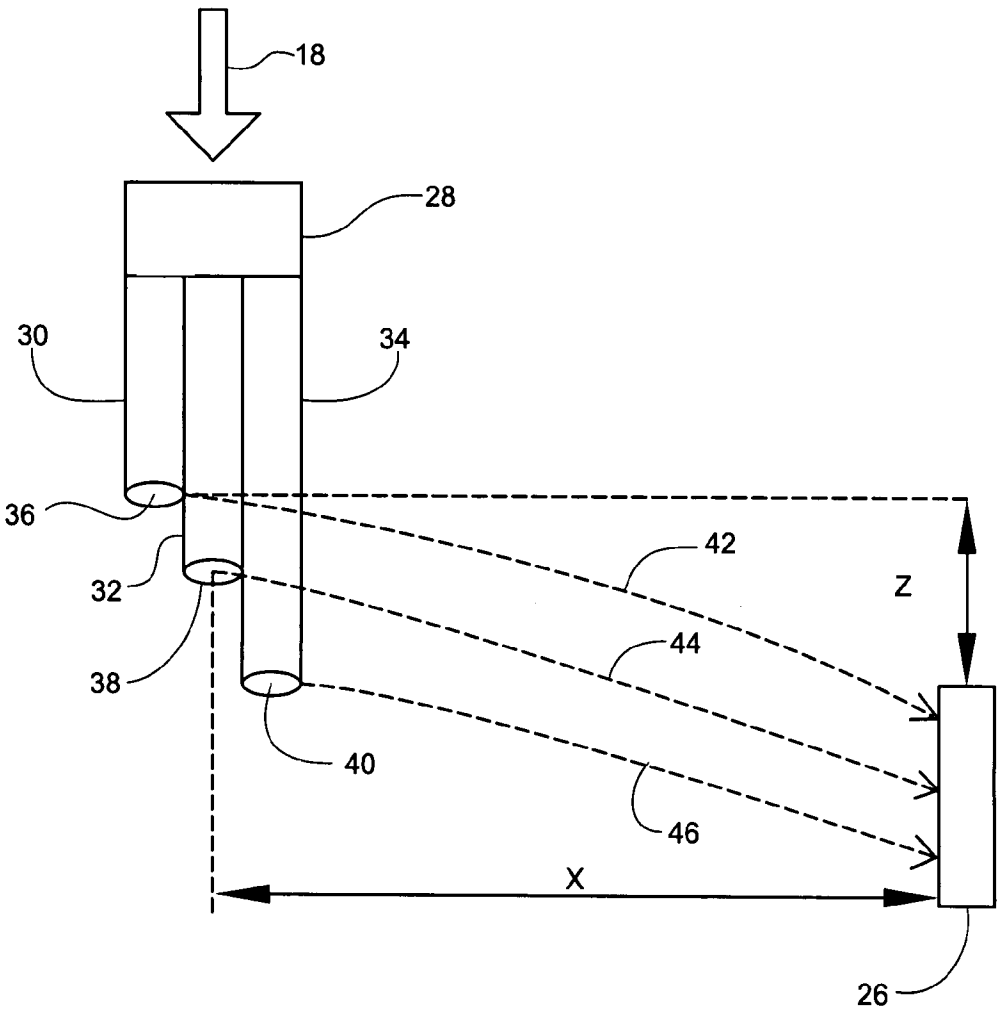
FIG. 2 is a diagram of a diffuser shown in FIG. 1 and its position with respect to a test sample.

Referring to FIGS. 1 and 2, in a preferred embodiment, apparatus 10 further comprises diffuser 28 located at the end of conduit network section 24B so that the output of diffuser 28 is directed into primary air stream 14. In one embodiment, diffuser 28 comprises a series of pipes 30, 32 and 34 progressively increasing in length. Each pipe 30, 32 and 34 has an opening 36, 38 and 40, respectively. Since the lengths of pipes 30, 32 and 34 are different, the openings 36, 38 and 40 are located at various angles and elevations in primary air stream 14 such that the density of particulate 22 in primary air stream 14 is uniform. Preferably, pipes 30, 32 and 34 are spaced apart so that openings 36, 38 and 40, respectively, are equally spaced apart and the distance between openings 36 and 40 is greater than or equal to the size of test sample 26. Preferably, opening 36 is at an elevation in the primary air stream 14 so that particulate 22 emanating from opening 36 travels in a direction indicated by path 42 and strikes an upper portion of test sample 26. Similarly, middle opening 38 is at an elevation in the primary air stream 14 so that particulate 22 emanating from opening 38 travels along path 44 and strikes a middle portion of test sample 26. Similarly, lowest opening 40 is at an elevation in the primary air stream 14 so that particulate 22 emanating from opening 40 travels along path 46 and strikes a lower portion of test sample 26. The distance X between diffuser 28 and test sample 26. The preferred relationship of the distance X between diffuser 28 and test sample 26 and the height Z between the top of test sample 26 and highest opening 36 is represented by equation (1):

$$Z=\tfrac{1}{2}(g)(X/V)^2 \quad (1)$$

wherein "V" is the velocity of primary air stream velocity 14 and "g" is the gravitational constant.

In a preferred embodiment, apparatus 10 is configured so that particulate 22 is sand and diffuser 28 releases the sand from at the top of primary air stream 14, as shown in FIG. 1, so the effect of gravity will reduce the required air pressure from second air stream generating device 16.

Referring to FIG. 1, in a preferred embodiment, conduit network 24 further comprises section 48 that is relatively wider than conduit network section 24A. Thus, primary air stream 14 travels through the relatively narrow conduit network section 24A to test sample 26 and then travels through the relatively wider section 48. The difference in cross-sections of the narrow and wide portions 24A and 48, respectively, should be such that the linear air velocity of primary air stream 14 decreases sufficiently in the relatively wider section 48 thereby enabling the particulate, e.g. sand, to drop out of primary air stream 14.

Referring to FIG. 1, in a preferred embodiment, apparatus 10 further comprises at least one filter 52 positioned downstream from test sample 26 to vent the airflow from conduit network 24. In a preferred embodiment, filter 52 is a high efficiency particulate air (HEPA) filter which reduces chronic inhalation hazards from fractured abrasive particles. Preferably the airflow capacity of filter 52 is matched to the combined output of primary and secondary air stream generating devices 12 and 16, respectively, to maintain the proper air velocity. Filter 52 preferably has a configuration that ensures the backpressure created by filter 52 is not higher than the rating of primary air stream generating device 12. This avoids premature wear of the motor in primary air stream generating device 12 and the resulting decrease in the velocity of the primary air stream 14 due to such motor wear.

Referring to FIG. 1, in a preferred embodiment, apparatus 10 further comprises control device 50 to adjust primary air stream generating device 12 so as to adjust or vary the air velocity of the primary air stream 14. For example, if primary air stream generating device 12 comprises a blower, then control device 50 adjusts the blower so as to adjust or vary the velocity of primary air stream 14. It has been found that different airspeeds can be used to mimic different weather conditions. Thus, control device 50 allows for the simulation of different weather conditions. In a preferred embodiment, control device 50 varies the velocity of the primary air stream 14 between about 10 and 60 mph. The ability to vary the velocity of primary air stream 14 also allows the use of a single type of particulate, e.g. sand or other abrasive particles, to simulate different types of abrasion by matching the kinetic energy (KE) of the abrasive particles to the kinetic energy of abrasive particles under the desired conditions wherein the kinetic energy is represented by equation (2):

$$KE=\tfrac{1}{2}mv^2 \quad (2)$$

wherein "m" is the mass of the abrasive particle and "v" is its velocity. Thus, a higher velocity primary air stream 14 can be used to simulate a slower moving, larger abrasive particle and a slower lower velocity primary air stream 14 can simulate a lighter, faster moving abrasive particle.

Figure 3:
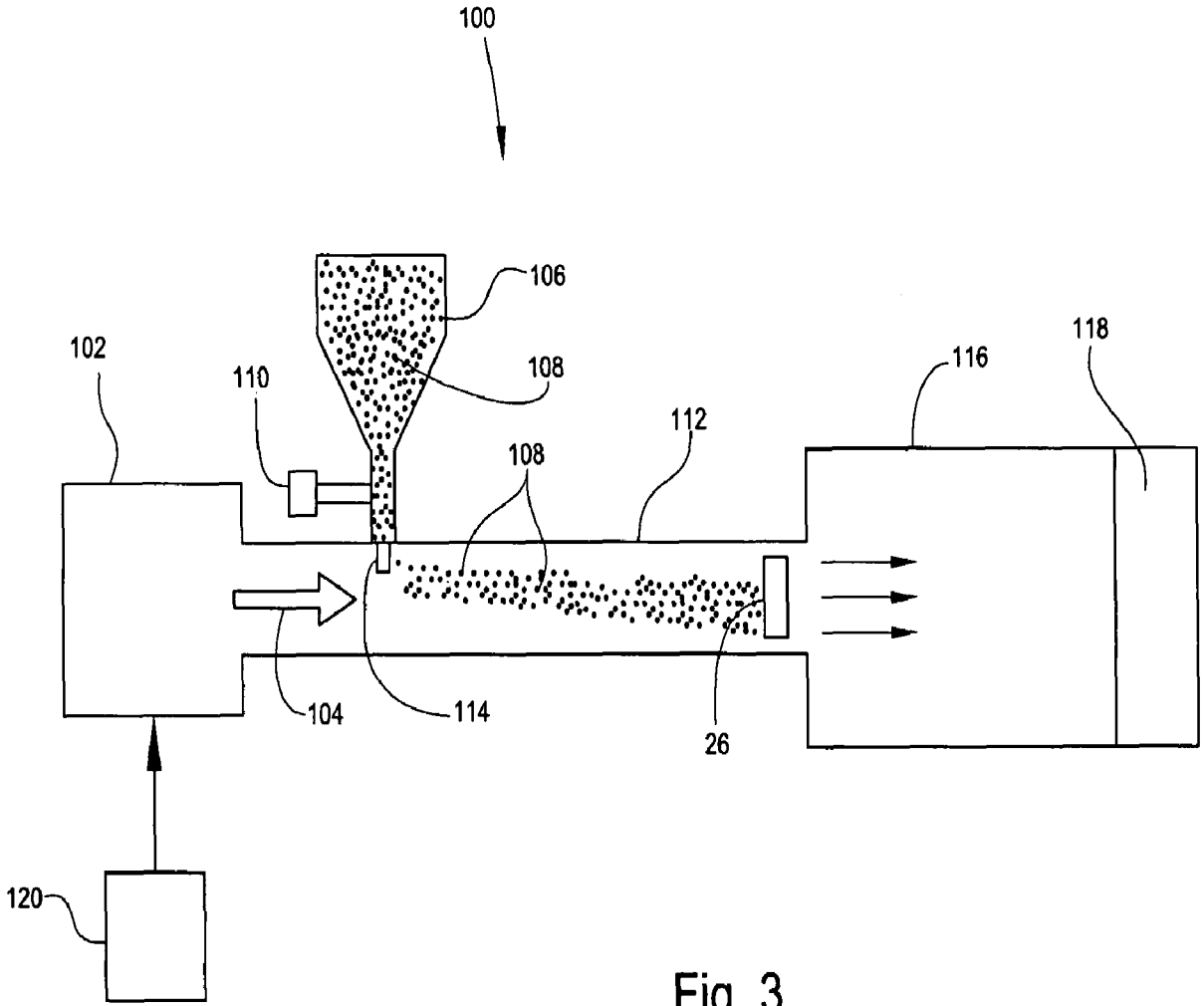
FIG. 3 is a diagram of an apparatus to test the abrasion resistance of materials in accordance with another embodiment of the present invention.

Referring to FIG. 3, there is shown apparatus 100 for testing the abrasion resistance of materials in accordance with another embodiment of the present invention. Apparatus 100 uses only a single air stream. Thus, apparatus 100 generally comprises air stream generating device 102 to generate air stream 104. Apparatus 100 further comprises particulate handling device 106 to deposit particulate 108 into air stream 104. In a preferred embodiment, particulate handling device 106 comprises a device 110 to meter the particulate 108 into air stream 104. In one embodiment, particulate handling device 108 comprises a motorized auger. Apparatus 100 further comprises conduit network 112. Conduit network 112 directs air stream 104 at a test sample 26 positioned within conduit network 112. In one embodiment, air stream generating device 102 is configured as a fan. In another embodiment, air stream generating device 102 is configured as a blower. Conduit network 112 can be configured with pipes, ducts, etc. Apparatus 100 further comprises diffuser 114 located within and joined to conduit network 112. Diffuser 114 has substantially the same structure as diffuser 28 (see FIG. 1) and performs the same function as diffuser 28 and therefore, is not discussed here in detail. The output of diffuser 114 is directed into air stream 104. In a preferred embodiment, apparatus 100 is configured so that particulate 108 is sand and diffuser 114 releases the sand from at the top of air stream 104 as shown in FIG. 3.

Referring to FIG. 3, in a preferred embodiment, conduit network 112 further comprises conduit 116 that is relatively wider than conduit network 112. Thus, air stream 104 travels through the relatively narrow conduit network 112 to test sample 26 and then travels through the relatively wider conduit 116. The difference in cross-sections of the narrow conduit network 112 and 116, respectively, should be such that the linear air velocity of air stream 104 decreases sufficiently in the relatively wider conduit 116 thereby enabling the particulate, e.g. sand, to drop out of air stream 104.

Referring to FIG. 3, in a preferred embodiment, apparatus 100 further comprises at least one filter 118 positioned downstream from test sample 26 to vent the airflow from conduit network 116. In a preferred embodiment, filter 118 is a high efficiency particulate air (HEPA) filter which reduces chronic inhalation hazards from fractured abrasive particles. Preferably, the airflow capacity of filter 118 is matched to the combined output of air stream generating device 102 to maintain the proper air velocity. Filter 118 preferably has a configuration that ensures the backpressure created by filter 118 is not higher than the rating of air stream generating device 102. This avoids premature wear of the motor in air stream generating device 102 and the resulting decrease in the velocity of air stream 104 due to such motor wear.

Referring to FIG. 3, in a preferred embodiment, apparatus 100 further comprises control device 120 to control air stream generating device 102 so as to adjust or vary the air velocity of air stream 104. For example, if air stream generating device 102 comprises a blower, then control device 120 adjusts the blower so as to adjust or vary the velocity of air stream 104. It has been found that different airspeeds can be used to mimic different weather conditions. Thus, control device 120 allows for the simulation of different weather conditions. In a preferred embodiment, control device 120 varies the velocity of air stream 104 between about 10 and 60 mph. The ability to vary the velocity of air stream 104 also allows the use of a single type of particulate, e.g. sand or other abrasive particles, to simulate different types of abrasion in the same manner as achieved by control device 50 (see FIG. 1).

Comparison tests were conducted using the present invention and a prior art Taber test method. The prior art Taber test imparted shallow scratches on the test sample while the test implemented in accordance with the present invention created larger impact sites on the test sample. This impact damage creates more visible haze in transparent materials.

The present invention obtains a more realistic and representative measure of actual performance of a coating by using the particulate and variable air speed to produce an impact on a test sample. Furthermore, the use of particulate, such as sand, in a relatively large cross-section of moving air better simulates natural conditions in comparison to prior art abrasion testing devices and techniques. Furthermore, such a device can simulate accelerated wear conditions by increased particulate density in the air stream.

An important advantage of the apparatus of the present invention is that it is relatively small in physical size and takes up less space in comparison to many prior art devices. Apparatuses 10 and 100 can also be scaled down to a size that will fit on a tabletop or lab bench for smaller test specimens.

Numerous commercial products are subject to blowing sand and other abrasive particulates during normal use. Since rubbing-type abrasion testers do not necessarily provide good predictive data of resistance to blowing particulate abrasion, the present invention will be of great value to the development of protective coatings and outdoor materials for a variety of industries, including eyewear, optical lenses, outdoor cameras and sensors, photovoltaic cells, fabrics, outdoor building materials, paint, vehicle parts, engine parts, etc. The present invention also has numerous military applications since it can provide important data about materials and equipment with respect to the resistance of such materials and equipment to abrasion by windborne or airborne particulate.

The foregoing description of the preferred embodiments of the invention has been presented for purposes of illustration and description only. It is neither intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. An apparatus to test abrasion resistance of materials, comprising:

a conduit;

an air stream generating device to generate an air stream in the conduit;

a control device to control the air stream generating device to vary the velocity of the air stream;

a particulate handling device to deposit particulate into the conduit so that the air stream blows the particulate toward a test sample positioned in the conduit, wherein the particulate handling device is configured to meter the particulate into the air stream;

a diffuser positioned within and joined to the conduit to diffuse the flow of particulate in the air stream so that the density of particulate in the air stream is substantially uniform, wherein the diffuser has a plurality of openings, each opening being at a particular height with respect to a test sample such that the opening at the greatest height allows particulate to strike an upper portion of the test sample, an opening at a height lower than the greatest height allows particulate to strike a middle portion of the test sample, and an opening at a lowest height allows particulate to strike a lower portion of the test sample; and wherein the control device varies the velocity of the air stream and the particulate handling device varies the amount of particulate metered into the air stream, such that the control device and particulate handling device may each work independently for controlling the amount of density of particulate in the air stream.

2. The apparatus according to claim 1 wherein the air stream generating device is configured to generate an air stream having a velocity between 10 and 60 mph.

3. The apparatus according to claim 1 wherein the conduit comprises a narrow portion and a relatively wider portion wherein the air stream flows through the narrow portion to a test sample and then continues to flow through the relatively wider portion.

4. The apparatus according to claim 3 further comprising at least one filter in the relatively wider portion of the conduit to vent the air stream from the conduit.

5. A method to test abrasion resistance of materials, comprising:

providing a conduit;

generating an air stream in the conduit;

controlling the generating of the air stream for varying the velocity of the air stream;

depositing particulate into the conduit so that the air stream blows the particulate toward a test sample positioned in the conduit;

metering the particulate into the air stream;

diffusing the flow of particulate in the air stream so that the density of particulate in the air stream is substantially uniform, wherein said diffusing being accomplished by a plurality of openings, each opening being at a particular height with respect to a test sample such that the opening at the greatest height allows particulate to strike an upper portion of the test sample, an opening at a height lower than the greatest height allows particulate to strike a middle portion of the test sample, and an opening at a lowest height allows particulate to strike a lower portion of the test sample; and wherein the control device varies the speed of the air stream, and the particulate handling device varies the amount of particulate metered into the air stream; such that the control device and particulate handling device may each work independently for controlling the amount of density of particulate in the air stream.

6. The method according to claim 5 wherein the air stream has a velocity between 10 and 60 mph.

7. The method according to claim 5 further comprising the step of filtering the air stream so as to vent the air stream from the conduit.

* * * * *